US006866768B2

(12) United States Patent
Bradford et al.

(10) Patent No.: US 6,866,768 B2
(45) Date of Patent: Mar. 15, 2005

(54) ELECTROLYTIC CELL FOR PRODUCTION OF ALUMINUM FROM ALUMINA

(76) Inventors: Donald R Bradford, 52 Sunrise Rd., Underwood, WA (US) 98651; Robert J. Barnett, 52 Adams Loop Rd., Goldendale, WA (US) 98620; Michael B. Mezner, 58830 E. Cabin La., Sandy, OR (US) 97055

( * ) Notice: Subject to any disclaimer, the term of this patent is extended or adjusted under 35 U.S.C. 154(b) by 74 days.

(21) Appl. No.: 10/387,602

(22) Filed: Mar. 14, 2003

(65) Prior Publication Data

US 2004/0011661 A1 Jan. 22, 2004

Related U.S. Application Data

(63) Continuation-in-part of application No. 10/195,733, filed on Jul. 16, 2002.

(60) Provisional application No. 60/434,108, filed on Dec. 17, 2002.

(51) Int. Cl.[7] ..... C25C 3/00; C25C 3/06; C25C 3/08; C25C 3/12

(52) U.S. Cl. ..... 205/376; 205/386; 205/387; 205/392; 205/394; 204/245; 204/280; 204/292; 204/293; 204/244

(58) Field of Search ..... 205/376, 380, 205/391, 396, 394, 386, 392; 204/291, 292, 293, 243.1, 280, 244, 245, 284

(56) References Cited

U.S. PATENT DOCUMENTS

| | | | | |
|---|---|---|---|---|
| 3,578,580 A | | 5/1971 | Schmidt-Hatting et al. | 204/243 |
| 3,960,678 A | | 6/1976 | Alder | 204/67 |
| 4,110,178 A | | 8/1978 | LaCamera et al. | 204/64 |
| 4,115,215 A | | 9/1978 | Das et al. | 204/67 |
| RE30,330 E | | 7/1980 | Das et al. | 204/67 |
| 4,243,502 A | | 1/1981 | Kugler | 204/243 |
| 4,338,177 A | | 7/1982 | Withers et al. | 204/243 |
| 4,342,637 A | | 8/1982 | Withers et al. | 204/282 |
| 4,592,812 A | | 6/1986 | Beck et al. | 204/67 |
| 4,670,110 A | | 6/1987 | Withers et al. | 204/67 |
| 4,865,701 A | | 9/1989 | Beck et al. | 204/67 |
| 4,904,356 A | | 2/1990 | Fray | 204/64 |
| 5,006,209 A | | 4/1991 | Beck et al. | 204/67 |
| 5,284,562 A | | 2/1994 | Beck et al. | 204/243 |
| 5,362,366 A | | 11/1994 | de Nora et al. | 204/67 |
| 5,415,742 A | * | 5/1995 | La Camera et al. | 205/336 |
| 5,498,320 A | | 3/1996 | Rendall | 205/205 |
| 6,436,272 B1 | * | 8/2002 | Brown et al. | 205/374 |
| 6,558,525 B1 | * | 5/2003 | Bradford et al. | 205/380 |

* cited by examiner

*Primary Examiner*—Donald R. Valentine
(74) *Attorney, Agent, or Firm*—Andrew Alexander

(57) ABSTRACT

Electrolysis of alumina dissolved in a molten salt electrolyte employing inert anode and cathodes, the anode having a box shape with slots for the cathodes.

48 Claims, 6 Drawing Sheets

ELECTROLYTIC CELL FOR PRODUCTION OF ALUMINUM FROM ALUMINA

CROSS REFERENCE TO RELATED APPLICATIONS

This application is a continuation-in-part of U.S. Ser. No. 10/195,733, filed Jul. 16, 2002, and also claims the benefit of U.S. provisional application Ser. No. 60/434,108, filed Dec. 17, 2002.

The government has rights in this invention pursuant to Contract No. DE-FC07-98ID13662 awarded by the Department of Energy.

BACKGROUND OF THE INVENTION

This invention relates to aluminum and more particularly it relates to an improved cell for use in the electrolytic production of aluminum from alumina dissolved in a molten salt electrolyte, for example, at low temperatures.

There is great interest in using an inert anode in an electrolytic cell for the production of aluminum from alumina dissolved in the molten salt electrolyte. By definition, the anode should not be reactive with the molten salt electrolyte or oxygen generated at the anode during operation. Anodes of this general type are either comprised of a cermet or metal alloy. For example, U.S. Pat. No. 4,399,008 discloses a composition suitable for fabricating into an inert electrode for use in the electrolytic production of metal from a metal compound dissolved in a molten salt. The electrode comprises at least two metal oxides combined to provide a combination metal oxide.

Also, U.S. Pat. No. 5,284,562 discloses an oxidation resistant, non-consumable anode for use in the electrolytic reduction of alumina to aluminum, which has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

Different processes and electrolytic cell configurations have been suggested for the electrolytic production of aluminum from alumina. For example, U.S. Pat. No. 3,578,580 discloses an apparatus for the electrolysis of molten oxides, especially of alumina, in which the anode is separated from the melt being electrolysed by a layer of oxygen-ion-conducting material, for example cerium oxide stabilized with calcium oxide or other oxides, which is resistant to the melt at the temperature of the electrolysis.

U.S. Pat. No. 4,338,177 discloses a cell for the electrolytic deposition of aluminum at low temperatures and low electrical potential in which the anode is the sole source of aluminum and comprises a composite mixture of an aluminous material such as aluminum oxide and a reducing agent. Conductor means of higher electrical conductivity than the mixture are provided to conduct substantially the entire anodic current to the active anode surface thereby reducing the voltage drop through the highly resistive composite mixture. The mixture may be employed in a self-baking mode or be prebaked. Alternatively, the mixture may be in a particulate form and contained within a porous membrane which passes the electrolyte or other dissolved material while withholding undissolved impurities. The cell may have bipolar electrodes and may be used in combined winning and refining configurations.

U.S. Pat. No. 3,960,678 discloses a process for operating a cell for the electrolysis of a molten charge, in particular aluminum oxide, with one or more anodes, the working surfaces of which are of ceramic oxide material, and anode for carrying out the process. In the process a current density above a minimum value is maintained over the whole anode surface which comes into contact with the molten electrolyte. An anode for carrying out the process is provided at least in the region of the interface between electrolyte and surrounding atmosphere, the three phase zone, with a protective ring of electrically insulating material which is resistant to attack by the electrolyte. The anode may be fitted with a current distributor for attaining a better current distribution.

U.S. Pat. No. 4,110,178 discloses a method and apparatus for producing metal by electrolysis in a molten bath of salt. The apparatus includes an electrolytic cell containing a molten bath of salt and a vertical stack of electrodes located within the bath of salt, with the uppermost electrode being located beneath the upper level of the bath. A baffle extends vertically above the uppermost electrode, the baffle being effective to direct a flow of the bath laterally and beneath the upper level of the bath, and to increase the velocity of the flow of the bath and metal between vertically adjacent electrodes of the vertical stack.

U.S. Pat. No. 4,115,215 discloses a process for purifying aluminum alloys which comprises providing molten aluminum alloy in a container having a porous wall therein capable of containing molten aluminum in the container and being permeable by the molten electrolyte. Aluminum is electrolytically transported through the porous wall to cathode thereby substantially separating the aluminum from alloying constituents.

U.S. Pat. No. 4,243,502 discloses a wettable cathode for an electrolytic cell for the electrolysis of a molten charge, in particular for the production of aluminum, where the said cathode comprises individual, exchangeable elements each with a component part for the supply of electrical power. The elements are connected electrically, via a supporting element, by molten metal which has separated out in the process. The interpolar distance between the anodes and the vertically movable cathode elements is at most 2 cm.

U.S. Pat. No. 4,342,637 discloses an anode for use in the electrolytic deposition of aluminum at low temperatures in which the anode is the sole source of aluminum and comprises a composite mixture of an aluminous material such as aluminum oxide and a reducing agent such as carbon. Conductor means of higher electrical conductivity than the anodic mixture are provided to conduct substantially the entire anodic current to the active anode surface thereby reducing the voltage drop through the highly resistive composite mixture.

U.S. Pat. No. 4,670,110 discloses a process for the electrolytic deposition of aluminum at low temperatures and at low electrical potential in which the anode is the sole source of aluminum and comprises a composite mixture of an aluminous material such as aluminum oxide and a reducing agent. The composite anode is positioned in the electrolyte with at least one active surface of the anode in opposed relationship to but spaced from the surface of the cathode. The greatly increased electrical resistance of the mixture of aluminum oxide and the reducing agent is minimized by passing the anodic current through one or more conductors of low electrical resistivity which extend through the mixture to or approximately to the active reaction face of the mixture in the electrolyte.

U.S. Pat. No. 4,904,356 discloses a carbon block which acts as a cell electrode. Channels are formed in its face which is to face the cell diaphragm. The channels provide an interconnected network including retention pools arranged to hold, release, break up and mix a liquid stream passing through them.

U.S. Pat. No. 5,362,366 discloses an anode-cathode arrangement for the electrowinning of aluminum from alumina dissolved in molten salts, consisting of an anode-cathode double-polar electrode assembly unit or a continuous double polar assembly in which the anode and cathode are bound together and their interelectrode gap is maintained substantially constant by connections made of materials of high electrical, chemical, and mechanical resistance. Multi-double-polar cells for the electrowinning of aluminum contain two or more of such anode-cathode double-polar electrode assembly units. This arrangement permits the removal of reimmersion into any of the anode-cathode double-polar electrode assembly units during operation of the multi-double-polar cell whenever the anode and or the cathode or any part of the electrode unit needs reconditioning for efficient cell operation.

U.S. Pat. No. 5,498,320 discloses a double salt of $KAlSO_4$, as a feedstock which is heated with a eutectic electrolyte, such as $K_2SO_4$, at 800° C. for twenty minutes to produce an out-gas of $SO_3$ and a liquid electrolyte of $K_2SO_4$ with fine-particles of $Al_2O_3$ in suspension having a mean size of six to eight microns. This is pumped into a cell with an electrolyte comprised of $K_2SO_4$ with fine-particles of $Al_2O_3$ in suspension, an anode and a porous cathode of open-cell ceramic foam material. The cell is maintained at 750° C. and four volts of electricity applied between the anode and the cathode causes oxygen to bubble at the anode and liquid aluminum to form in the porous cathode. A channel within the porous cathode, and the porous cathode itself, are deep enough within the cell electrolyte that the pressure head of electrolyte is enough to overcome the difference in density between the molten aluminum and the electrolyte to pump molten aluminum from the channel out of the side of the cell. The electrolyte $K_2SO_4$ is periodically bled-off to control a build-up of the material as aluminum is produced from the double salt of $KAlSO_4$.

In spite of these disclosures, there is still a great need for an electrolytic cell and process for operating the cell at low temperatures that permits efficient electrolytic reduction of alumina to aluminum and removal of molten aluminum without contaminating the aluminum with alumina particles, for example. Further, it is important to remove or drain the molten aluminum from the cathode and collect it in a pool unaffected by turbulence in the bath or molten electrolyte created by evolution of gas such as oxygen at the anode. In addition, it is important to substantially electrically isolate the pool of aluminum in the bottom of the cell from the cathode to avoid parasitic electrical current and losses in current efficiency. The subject invention solves these problems by use of a novel cell and anode which permits efficient removal of molten aluminum from the cathode.

SUMMARY OF THE INVENTION

It is an object of the present invention to provide an improved method for producing aluminum from alumina in an electrolytic cell.

It is another object of the invention to provide an improved method for producing aluminum from alumina in an electrolytic cell employing inert or unconsumable anodes.

It is another object of the invention to efficiently remove and collect aluminum from the cathode in an electrolytic cell for producing aluminum from alumina.

Yet, it is another object of the invention to remove aluminum from electrolytic cell substantially free of contamination with alumina particles, for example.

And yet, it is another object of the invention to remove aluminum from electrolytic cell unaffected by turbulence in the cell created by oxygen evolution at the anode.

Still yet, it is a further object of the invention to collect the molten aluminum in a metal pad in the bottom of the cell substantially unaffected by parasitic electrical currents, thereby improving metal production efficiency.

These and other objects will become apparent from the specification, claims and drawings appended hereto.

In accordance with these objects, there is disclosed a method of producing aluminum in an electrolytic cell containing alumina dissolved in a molten electrolyte. The method comprises providing a molten salt electrolyte having alumina dissolved therein in an electrolytic cell having a liner containing molten electrolyte and a pool of molten aluminum, the liner having a bottom and walls extending upwardly from the bottom, the pool of molten aluminum located on the bottom and molten electrolyte located on top of the pool of molten aluminum. An anode assembly or box is located in the electrolyte above the pool of molten aluminum, the anode box comprised of a first side, a second side and a bottom, the first and second sides disposed substantially opposite each other. Two anode panels extend in a generally vertical direction between the first side and the second side to form a cathode slot. The anode box contains a plurality of spaced-apart cathode slots and regions between the slots. A cathode is provided in each of the cathode slots, the cathode having a bottom end. The anode box has openings in the bottom thereof substantially opposite the bottom end of each of the cathodes. Electric current is passed through the anode box to flow electric current from the anode panels through the electrolyte to the cathode, depositing aluminum at the cathode and producing gas at the anode panels. Aluminum is drained from the bottom end of the cathode through the openings in the bottom of the anode box to the pool of molten aluminum. Molten electrolyte is circulated upwardly in the cathode slot between the anode panels and the cathode and downwardly in regions outside the cathode slot.

Also disclosed is an improved anode for use in an electrolytic cell for producing aluminum from alumina dissolved in molten salt electrolyte contained in the cell, wherein aluminum is deposited at a substantially inert cathode and gas is generated at a substantially inert anode assembly when electric current is passed through the cell. The anode assembly is designed to be disposed in the electrolyte above a pool of molten aluminum. The anode assembly is comprised of a first side, a second side and a bottom, the first and second sides are disposed substantially opposite each other and attached to the bottom. Two anode panels are extended in a generally vertical direction between the first side and the second side to form a cathode slot for receiving a cathode to provide two anode panels for each cathode. The assembly can contain a plurality of spaced-apart cathode slots. The bottom of the anode assembly has an opening therein substantially opposite each of the cathodes to permit molten aluminum to drain from the cathode to the pool of molten aluminum during electrolysis.

DETAILED DESCRIPTION OF PREFERRED EMBODIMENTS

The subject invention includes an electrolytic cell for the production of aluminum from alumina dissolved in a molten salt electrolyte. Preferably, the molten electrolyte is maintained at a temperature of less than 900° C. However, electrolytes such as cryolite may be used at higher temperatures, e.g., 925° to 975° C. Further, preferably, the alumina is added to the cell on a continuous basis to ensure a controlled supply of alumina during electrolysis. The electrolytic cell of the invention employs a box-shaped anode and planar cathodes. In the process of the invention, electric current is passed from the box-shaped anode through the molten electrolyte to cathodes, reducing alumina to aluminum and depositing the aluminum at the cathodes.

Figure 1:
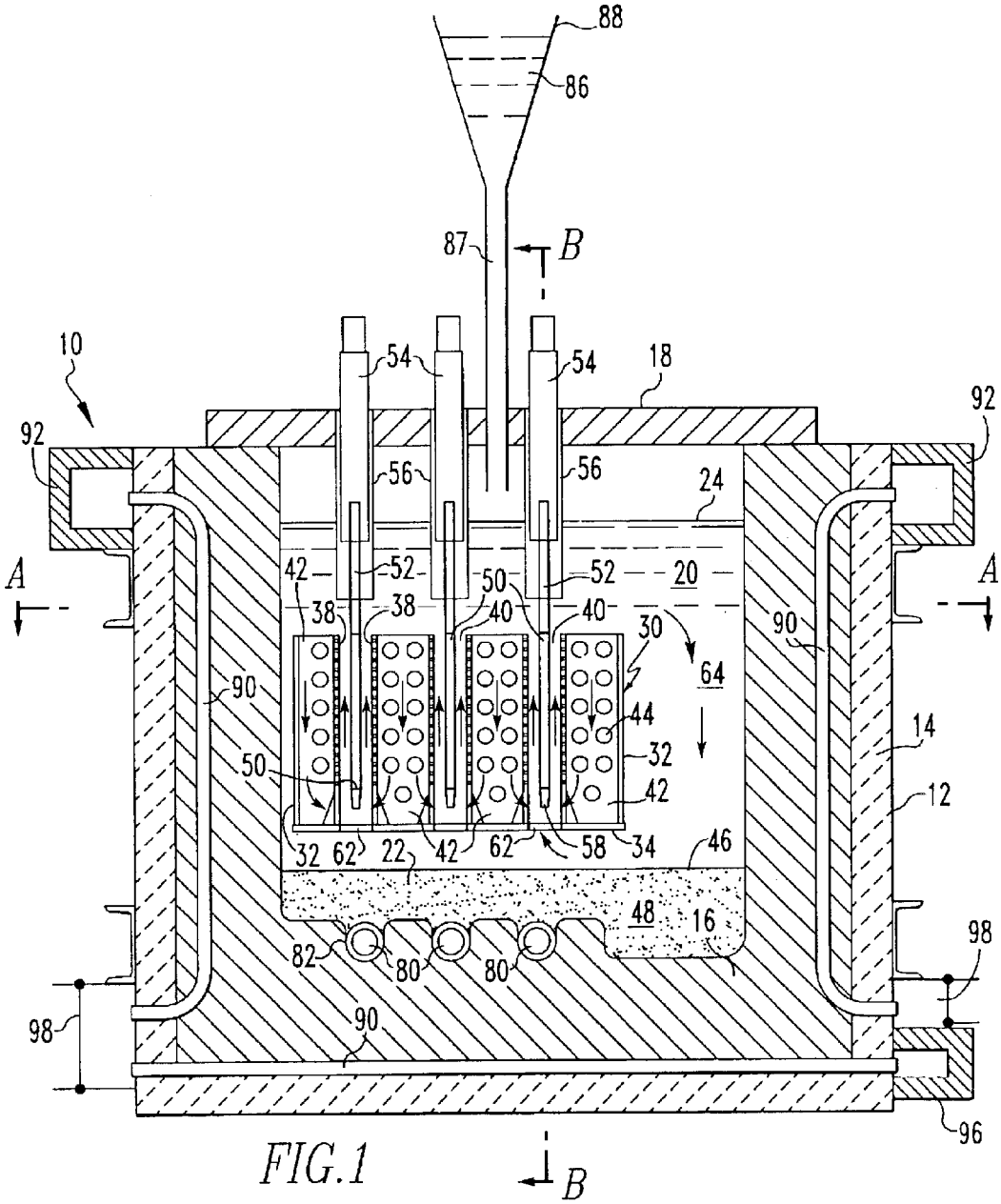
FIG. 1 is a cross-sectional view of an electrolytic cell of the invention.

Referring now to FIG. 1, there is shown a schematic of an electrolytic cell 10 for electrolytically reducing alumina to aluminum, in accordance with the invention. Cell 10 is comprised of a metal shell 12. In the embodiment shown in FIG. 1, a layer 14 of a low density insulating castable refractory, such as Rescor 740, available from Cotronics Corporation, is used adjacent metal shell 12. A layer 16 of high density alumina castable such as Rescor RTC-60, also available from Cotronics Corporation, is used adjacent layer 14 to contain the molten electrolyte and molten aluminum. It should be understood that any refractory may be used that functions to contain the molten electrolyte and molten aluminum. Cell 10 is sealed with a lid 18. Molten electrolyte 20 is shown in cell 10 resting on a layer or pool 22 of molten aluminum. The molten electrolyte has a surface 24.

Located in the body of electrolyte is an anode assembly or box 30. In the embodiment shown in FIG. 1, anode assembly 30 has sides 32 fastened to bottom 34. As will be seen in FIG. 2, which is a cross-sectional view along the line A—A in FIG. 1, sides 32 are connected to opposing sides 36 to form a generally box-shaped structure.

Figure 2:
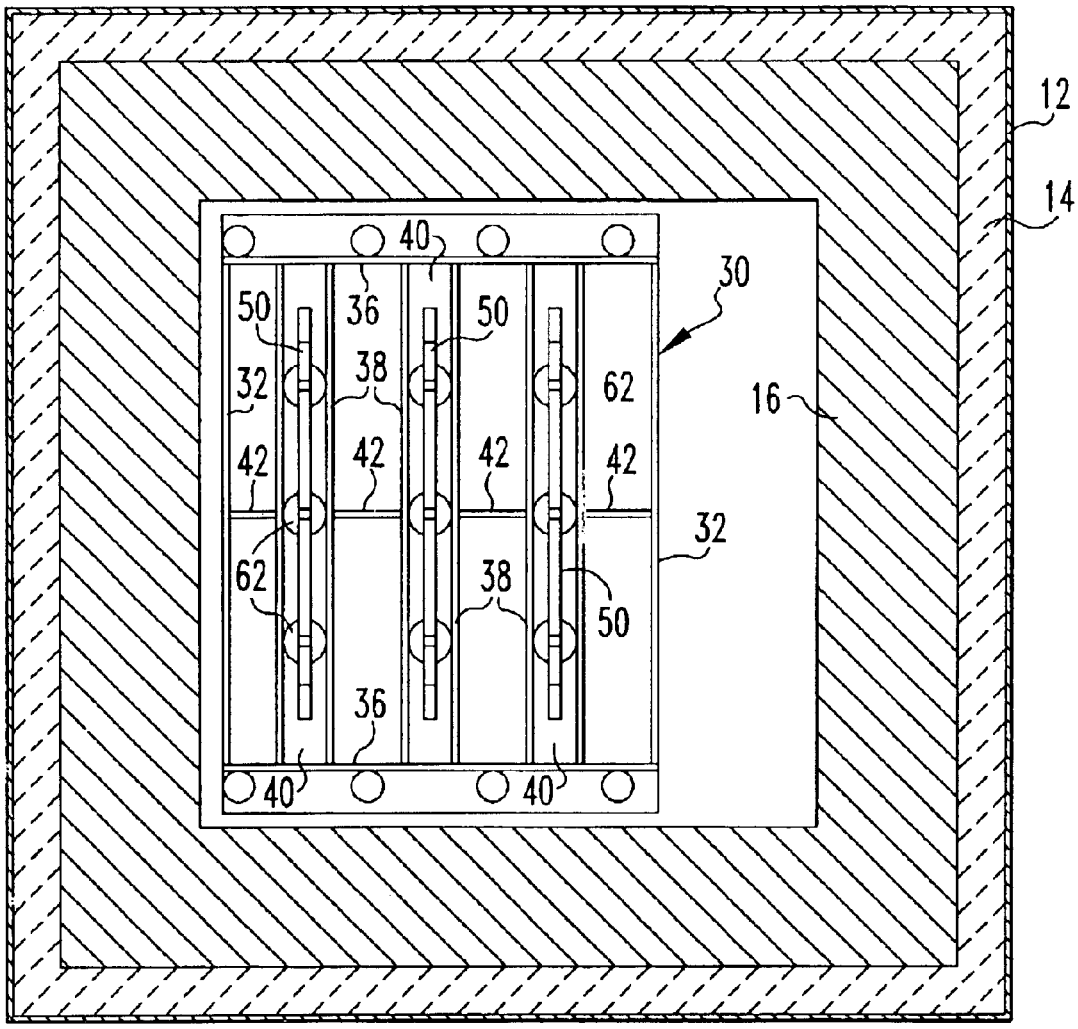
FIG. 2 is a top cross-sectional view along the line A—A of FIG. 1.

Anode assembly 30 has anode plates 38 which extend from sides 36 to form a cothode slot 40. Three cathode slots are shown in FIGS. 1 and 2. Also, in the embodiment shown in FIGS. 1 and 2 are spacers or support webs 42 which are used to minimize movement or deflection of anode plates 38 at operating temperatures. Holes or openings 44 are provided in webs 42 to permit free flow or circulation of molten electrolyte. Webs 42, as well as being joined to sides 32 and anode plates, may be fastened or joined to bottom 34.

In the embodiment shown in FIGS. 1 and 2, cathode 50 is shown positioned in each of the cathode slots 40 and thus, in this embodiment there is provided two anode panels for each cathode.

In FIG. 1, anode box 30 is positioned above surface 46 of molten aluminum poll 22 and below surface 24 of molten electrolyte 20. Further, it should be noted that anode box 30 is positioned to permit access to well 48 of aluminum with a siphon tube (not shown) for purposes of removing molten aluminum product. Other known methods of removing molten aluminum may be used. Anode box 30 may be held in place by any means that provide the required distance between the anode and cathode surfaces in cathode slot 40 and locates the box in the electrolyte as shown. In the present embodiment, anode box 30 and cathodes 50 are suspended from lid 18.

Typically, the cathodes are fabricated from titanium diboride although other materials may be used. In FIG. 1, the cathode has an arm 52 extending above the anode box, the arm connected to member 54 which extends through lid 18. A refractory sleeve 56, e.g., alumina, is provided around arm 52 and member 54. The sleeve serves to protect the titanium diboride from air burning at operating temperatures. Further the sleeve may be filled with alumina to minimize or avoid aluminum deposited at the cathode during electrolysis creeping up arm 52 and becoming oxidized at surface 24, thereby adversely affecting the efficiency of the cell. Member 54 may be comprised of molybdenum or like metal.

Figure 3:
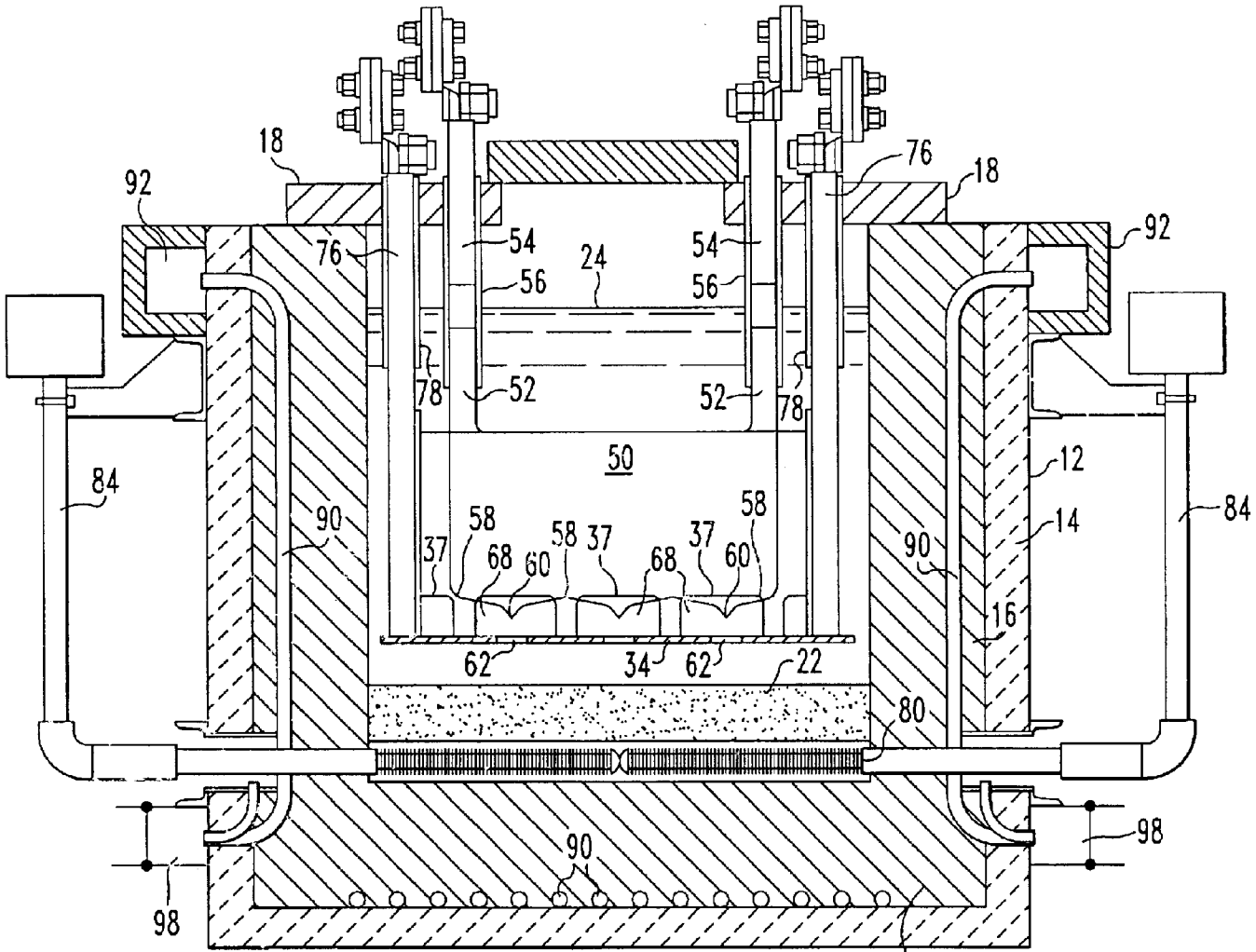
FIG. 3 is a cross-sectional view along the line B—B of FIG. 1.

It will be noted that cathodes 50 have a bottom edge 58 which extends to tips 60 (see FIG. 3). Each tip 60 is positioned above and opposite holes or openings 62 in bottom 34 of anode box 30. Thus, during electrolysis aluminum deposited on the cathode surface collects at tip 60 before dropping or draining off and passing through hole or opening 62 to collect in pool 22.

Figure 4:
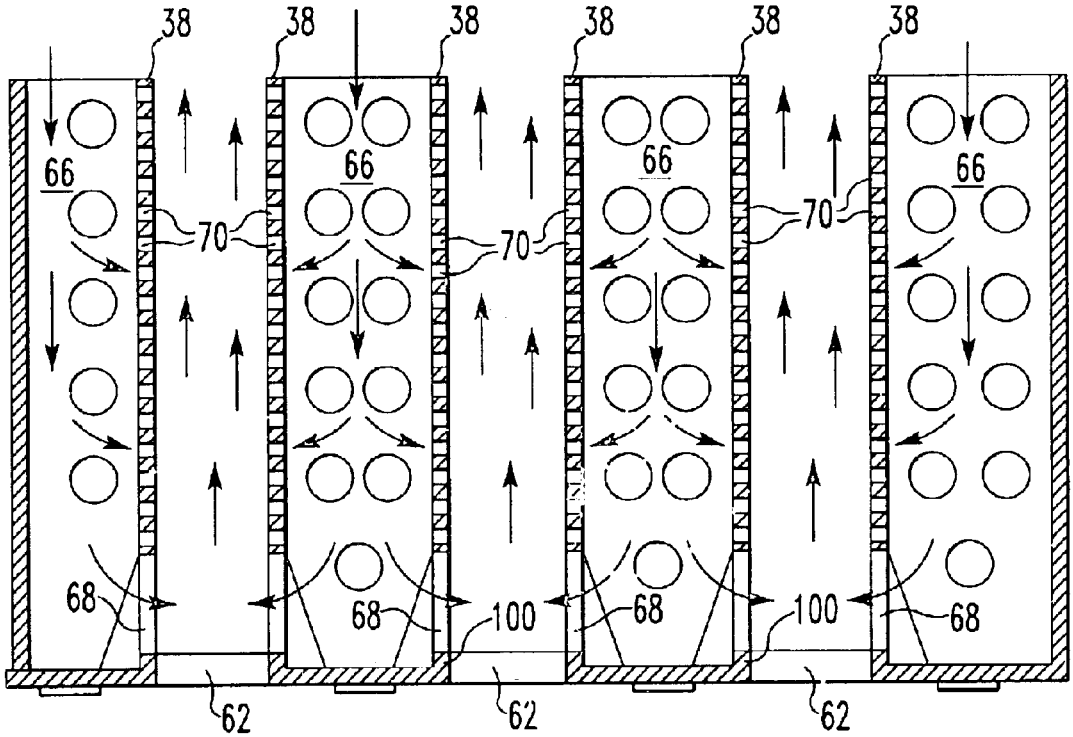
FIG. 4 is a cross-sectional side view of the anode box.

From FIG. 1, it will be seen that during electrolysis a molten electrolyte flow pattern develops in anode box 30 and in the cell outside the anode box. That is, during electrosis, aluminum is deposited at the cathode and drains downwardly on the cathode as noted. At the same time, gas bubbles are evolved at anode plates 38 opposite the cathode and because of buoyant force are carried upwardly, creating lift to the molten electrolyte. This provides upward flow of electrolyte between the cathode and anode plates in the cathode slot and downward flow outside the cathode slot, as shown by flow direction arrows in FIG. 1. Flow direction arrows are also shown in anode box 30, FIG. 4.

With reference to FIG. 1, electrolyte is shown flowing downwardly outside anode box 30, as illustrated by arrows in region 64. Downward flow in this region has the effect of creating upward flow of electrolyte through openings 62. Thus, if the cell is operated with alumina in excess of solubility or in a slurry mode, then upward flow through openings 62 minimizes or avoids settling out of alumina particles from anode box 30 onto the surface of molten aluminum pool 22. As will be seen in FIGS. 1, 3 and 4, to permit electrolyte flow downwardly between cathode slots 40 in regions 66 (see FIG. 4), openings 68 are provided in anode plates 38 through which the electrolyte can flow as it carries alumina-enriched electrolyte to the region between anode plates and the cathode. Further, as an aid to providing alumina-enriched electrolyte for electrolysis between the cathode and the anode plates, the anode plates may be provided with a plurality of openings 70 through which electrolyte can flow. It should be noted that solid anode plates may be used as long as openings 68 or other means are provided to flow electrolyte into the cathode slot.

Figure 6:
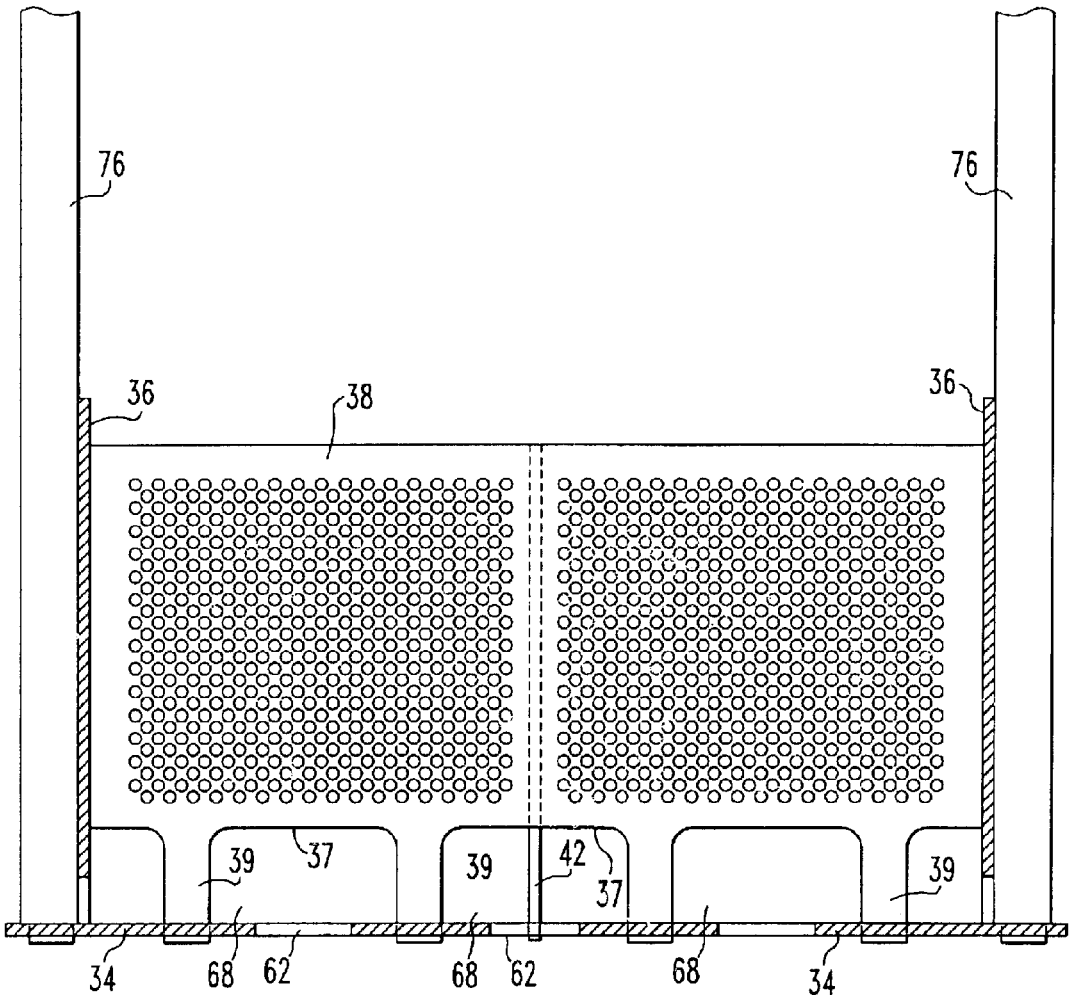
FIG. 6 is a top cross-sectional view of the anode box showing an anode plate, bottom and anode risers.

FIG. 6 is a cross-sectional view showing anode plates 38, bottom 34, side 36 and anode risers 76. From an inspection of FIG. 6, it will be seen that anode plates 38 have openings 68 and are spaced away from bottom 34 using legs 39.

Figure 5:
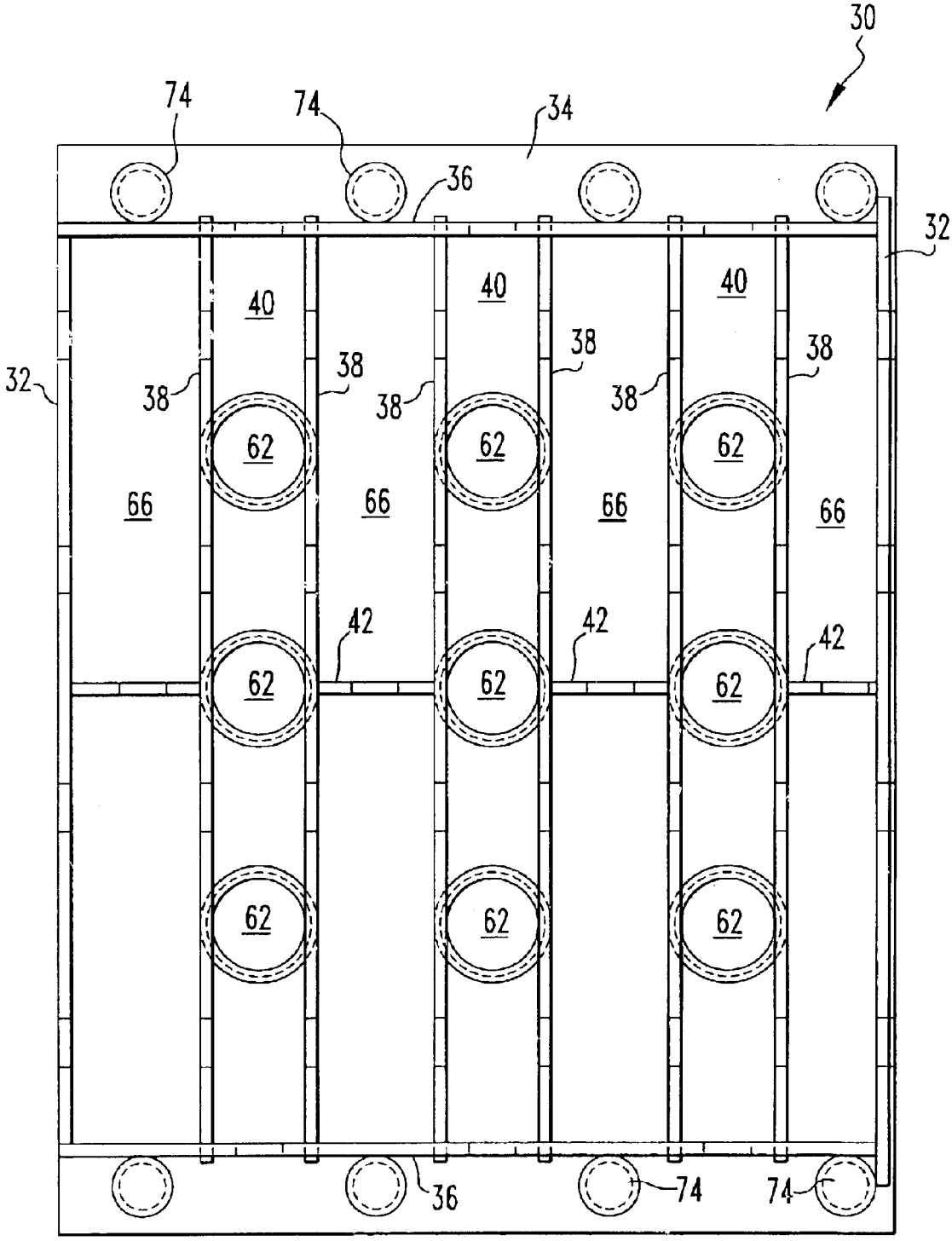
FIG. 5 is a top view of the anode box.

FIG. 5 is a top view of anode box 30 without cathodes in place showing sides 32 and 36 with anode plates 38 extending between sides 36, thereby defining cathode slots 40. At the bottom of each cathode slot 40 are shown three openings 62 in bottom 34 which permit aluminum to drain from the cathode tips into the pool of aluminum (see FIG. 3). It will be appreciated that while three openings 62 are shown, a lesser or greater number of openings 62 may be used, depending on the cell. Further, the openings may have a configuration other than circular.

In FIG. 5, there are shown openings 74 in bottom 34. These openings are used to connect one end of anode risers 76 (FIG. 3) to bottom 34. The other end of riser 76 is connected to lid 18. A protective sleeve 78 is provided around anode riser 76 to avoid corrosion at electrolyte line 24. As noted, the lid is then used to suspend anode box 30 in the electrolyte (see FIG. 3).

Referring again to FIG. 1, there are shown heaters 80 located underneath aluminum pool 22. Heaters 80, which are optional, are disposed in troughs 82. In the embodiment shown, the heaters are immersed in molten aluminum. By using troughs 82 all of the molten aluminum is not removed during normal tapping and thus the protective coating in the heaters only has to be resistant to molten aluminum without consideration for molten electrolyte. A protective coating of SiAlON is used for protection against molten aluminum. Optional heaters 80 may be used, for example, for experimental purposes, when the cell is operated at low current levels, e.g., 0.15 to 0.5 A/cm$^2$ and during startup to melt aluminum or bath. FIG. 3 shows heaters 80 extending across bottom 23 of cell 10 and connected to a power source via conduit 84. In a preferred design, start-up electrolyte melt is heated externally, and thus heaters would not be required.

In FIGS. 1 and 3, cooling tubes 90 are shown embedded in refractory layer 16 and exiting into plenums 92 and 96. Cooling tubes 90 are provided on all four sides and across the bottom of the cell. Cooling air can be pumped into the tubes at 98 and 99 to provide for temperature control of the cell. Refractory thickness and cooling are designed in order that the bath temperature can be maintained or controlled to a given set point even under high energy input to the cell. Minimum cooling air may be provided to ensure that the temperature of the refractory lining does not exceed the melting temperature of the electrolyte or molten aluminum. Thus, if cracks develop in the refractory lining, molten electrolyte or molten aluminum freezes or solidifies before reaching cooling tubes 90.

As illustrated in FIG. 1, alumina 86 is introduced to the cell from hopper 88 through lid 18 to electrolyte 20 on a continuous basis. It is preferred that alumina be introduced above anode box 30 to minimize circulation thereof in the direction of molten aluminum pool 22. Alumina used in the cell can be any alumina comprised of finely divided particles. The alumina can have an average particle size up to about 100 $\mu$m. Feeding alumina through lid 18 has the advantage that feed tube 87 permits gases such as oxygen to escape from the cell. In addition, electrolyte components such as fluorides entrained in the gas are scrubbed from the escaping gas by the alumina and returned to the cell, thereby minimizing loss of electrolyte in this manner and maintaining the electrolyte composition relatively constant.

It is desirable to add alumina 86 from hopper 88 continuously to molten electrolyte 20 to maintain electrolyte 20 close to saturation or above saturation. Maintaining alumina at saturation or above is desirable in order to provide immediate availability of alumina for dissolution. This maintains saturation in the electrolyte and avoids starvation of dissolved alumina at the anode surface. Maintaining saturation is beneficial because it minimizes oxidation and reduction of the anode metal. However, when alumina is maintained at saturation or above saturation, a build-up of undissolved alumina particles can occur inside anode box 30 on bottom 34. It has been discovered that the problems of build-up and contamination can be greatly minimized or avoided if the molten metal is collected and sequestered in pool 22 substantially isolated from the electrolysis operation by anode bottom 34. That is, pool 22 of aluminum is substantially unaffected by the electrolysis operation and bath flow. Further, any alumina collected on bottom 34 tends to be ingested into the electrolyte as it circulates in and around the anode box. In addition, because bottom 34 is anodic, it produces oxygen gas which assists in ingesting or entrainment of the alumina in the electrolyte.

In the present invention, the cell can be operated at a current density in the range of 0.1 to 1.5 A/cm$^2$ while the electrolyte is maintained at a temperature in the range of 660° to 860° C. A preferred current density is in the range of about 0.4 to 1.3 A/cm$^2$. The lower melting point of the bath (compared to the Hall cell bath which is above 950° C.) permits the use of lower cell temperatures, e.g., 730° to 860° C. and reduces corrosion of the anodes and cathodes.

Anode plates 38 and cathodes 50 in the cell can be spaced to provide an anode-cathode distance in the range of ¼ to 1 inch. The anode-cathode distance is the distance between anode surface facing the cathode and the cathode surface.

While the cathodes are preferably comprised of titanium diboride, it will be understood that the cathodes can be comprised of any suitable material that is substantially inert to the molten aluminum at operating temperatures. Such materials can include zirconium boride, molybdenum, tungsten, titanium carbide and zirconium carbide.

The box anode can be comprised of any non-consumable anode material selected from cermet, metal, metal alloy substantially inert to electrolyte at operating temperatures. By the use of the terms inert or non-consumable is meant that the anodes are resistant to attack by molten electrolyte and do not react or only slightly react in a manner not detrimental to aluminum metal produced. The cermet is a mixture of metal such as copper and metal oxides or other metal compound. The metal anode material is substantially free of metal oxides. A preferred metal, non-consumable anode material for use in the cell is comprised of iron, nickel, copper. The metal anode material can contain about 1 to 50 wt. % Fe, 15 to 50 wt. % Ni, the remainder comprising copper. A preferred anode material consists essentially of 1–30 wt. % Fe, 15–60 wt. % Ni, and 25 to 70 wt. % Cu. Typical non-consumable anode material can have compositions in the range of 20 to 50 wt. % Fe, 15 to 50 wt. % Ni and 20 to 70 wt. % Cu.

The electrolytic cell preferably has an operating temperature less than 900° C. and typically in the range of 660° C. to about 860° C. Typically, the cell can employ electrolytes comprised of NaF+$AlF_3$ eutectics, KF+$AlF_3$ eutectic, and LiF. A typical electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

In start-up and operation of the cell, solid aluminum is placed in the bottom of the cell and melted to cover heaters 80. Also, electrolyte is provided in the cell and melted. Auxiliary heaters may be used in melting the aluminum and the electrolyte. The lid and attached anode box and cathodes are preferably heated separately in a controlled atmosphere and then placed in the cell prior to electrolysis. Anode risers 76 are connected to a power source and electric current introduced to the cell to energize the anode box. Thus, electric current is passed from anode plates 38 through the molten electrolyte to cathodes 50. Oxygen or oxygen containing gas is evolved at the anode assembly and aluminum is deposited at the cathodes. Concurrently therewith, alumina is continuously added from hopper 88 to maintain the desired level in the molten electrolyte. Molten aluminum deposited at the cathode drains towards tips 60 and collects there. When the amount of aluminum collecting on the tip becomes sufficiently large, a portion or body breaks off and falls through openings 62 to collect in pool 22.

It will be appreciated that the densities of the molten electrolyte and the molten aluminum are balanced to provide a downward driving force for the molten aluminum bodies or portions falling from the cathode tips. Thus, typically the molten electrolyte will have a density in the range of 1.6 to 2 $gm/cm^3$ and the molten aluminum 2.3 to 2.4 $gm/cm^3$.

By referring to FIGS. 1 and 3, it will be seen that bottom sections 37 of anode plate 38 are located above cathode tip 60. This is important in that as molten aluminum collects on cathode tip 60, it does not change or only minimally changes the anode-cathode distance and therefore does not substantially distort or change the anode current density of the cell. That is, for example, resistant levels between the anode plates and cathode can be maintained at a controlled level with only minimal variation and maximum desirable current density is not exceeded on any portion of the anodes.

Because alumina is introduced into the cell above anode box 30, the bulk of the alumina introduced is ingested and directed downwardly in regions 66 (see FIG. 4) between cathode slots 40. To minimize the tendency for undissolved alumina to migrate or flow downwardly through openings 62, a ring 100 (FIG. 4) may be provided around opening 62 having the shoulder thereof projecting upwardly above bottom 34. Shoulder 100 would operate to stop and collect solid alumina particles settling on bottom 34 until they become dissolved in the electrolyte. This arrangement is particularly effective when the cell is being operated under slurry mode, i.e., greater than alumina saturation in the molten electrolyte.

It should be noted that anode assembly bottom 34 has an important function during electrolysis. That is, in addition to capturing undissolved alumina particles, anode bottom 34 operates to minimize the electrolysis path or current flow path from the cathodes to pool 22 of molten aluminum and thus provides a shield. If bottom 34 did not provide a shield from metal pad 22 to cathodes 50 during electrolysis, an electrical current path would exist between the bottom of anode plates 38 and metal pad 22. Further, there would be a selective current path from metal pad 22 back to cathodes 50. This would result in new aluminum being produced at the aluminum pad. However, an equal amount of aluminum is re-oxidized on the cathode side. The net result is that no new aluminum is produced. The electric current flow through this path is wasted and metal production efficiency is reduced.

The cell of the present invention has the advantage that it permits tapping or removing molten aluminum therefrom using conventional means. Further, the use of bottom 34 reduces or eliminates stray currents or parasitic currents between the metal pad and the electrodes, thereby improving the efficiency of the cell. In addition, when bottom 34 of the anode box is active, it permits the use of a slurry electrolyte during electrolysis with substantial freedom from alumina contamination of the molten metal. Also, the means described for draining molten aluminum from the cathodes avoids significant contamination of the molten metal in the pool with alumina particles. Another advantage is the auxiliary heating and cooling of the cell, which permits temperature control of the cell without necessarily modifying cell voltage or electric current.

Having described the presently preferred embodiments, it is to be understood that the invention may be otherwise embodied within the scope of the appended claims.

What is claimed is:

1. A method of producing aluminum in an electrolytic cell containing alumina dissolved in a molten electrolyte, the method comprising:

(a) providing a molten salt electrolyte having alumina dissolved therein in an electrolytic cell having a liner containing molten electrolyte and a pool of molten aluminum, said liner having a cell bottom and walls extending upwardly from said cell bottom, said pool of molten aluminum located on said cell bottom and molten electrolyte located on top of said pool of molten aluminum;

(b) locating an anode assembly in said electrolyte above said pool of molten aluminum, said anode assembly comprised of:

(i) a first side, a second side and an anode bottom, said first and second sides disposed substantially opposite each other;

(ii) two anode panels extending in a generally vertical direction between said first side and said second side to form a cathode slot for receiving a cathode to provide two anode panels for each cathode, said assembly containing a plurality of spaced apart cathode slots defining a region therebetween;

(c) providing a cathode in each of said cathode slots, said cathode having a bottom end, said anode bottom having an opening therein opposite said bottom end of said cathode;

(d) passing electric current through said anode assembly to flow electric current from said anode panels through said electrolyte to said (e) draining aluminum from said bottom end of said cathode through said opening in said anode bottom to said pool of molten aluminum; and (f) circulating molten electrolyte upwardly in said cathode slot between said anode panels and said cathode and downwardly outside said cathode slots.

2. The method in accordance with claim 1 wherein said electrolyte is comprised of one or more alkali metal fluorides.

3. The method in accordance with claim 1 wherein said electrolyte is comprised of one or more alkali metal fluorides and aluminum fluoride.

4. The method in accordance with claim 1 including maintaining said electrolyte in a temperature range of about 6600 to 860° C.

5. The method in accordance with claim 1 wherein said electrolyte has a melting point in the range of 715° to 860° C.

6. The method in accordance with claim 1 including passing an electric current through said cell at a current density in the range of 0.1 to 1.5 A/cm.

7. The method in accordance with claim 1 wherein said anodes are comprised of 10 to 70 wt. % Cu, 15 to 60 wt. % Ni, the remainder iron, incidental elements and impurities.

8. The method in accordance with claim 7 wherein said cathodes are selected from the group consisting of titanium diboride, zirconium diboride, titanium carbide, zirconium carbide and molybdenum.

9. The method in accordance with claim 1 including adding alumina to said cell on a substantially continuous basis.

10. The method in accordance with claim 1 including maintaining alumina in said electrolyte in excess of solubility.

11. The method in accordance with claim 1 including adding said alumina to the surface of said electrolyte substantially opposite said anode assembly to ingest alumina in said electrolyte circulating downwardly in regions between said cathode slots.

12. The method in accordance with claim 1 wherein said anode panels are perforated to flow alumina-rich electrolyte into said cathode slot.

13. The method in accordance with claim 1 wherein said anode panels have openings therein adjacent said anode bottom to flow alumina-rich electrolyte into said cathode slot and upwardly between said anode plates and said cathode.

14. The method in accordance with claim 1 wherein said anode assembly is box shaped.

15. The anode box in accordance with claim 1 wherein said anode box is comprised of a material selected from the group consisting of cermet, metal and metal alloy.

16. The anode box in accordance with claim 1 wherein said anode box is comprised of a Cu—Ni—Fe alloy.

17. In an improved method of producing aluminum in an electrolytic cell containing alumina dissolved in a molten electrolyte, using substantially nonconsumable anodes and cathodes in the electrolytic cell, the cell having a liner containing molten electrolyte resting on a pool of molten aluminum, the improved method comprising:

(a) providing a substantially inert anode box in said electrolyte above said pool of molten aluminum, said anode box comprised of:

(i) a first side, a second side and an anode bottom, said first and second sides disposed substantially opposite each other; and (ii) two anode panels extending in a generally vertical direction between said first side and said second side to form a cathode slot for receiving a cathode to provide two anode panels for each cathode, said box containing a plurality of spaced-apart cathode slots defining a region therebetween;

(b) locating an inert cathode having bottom end in said cathode slot, said anode bottom having an opening therein substantially opposite said bottom end of said cathode;

(c) passing electric current through said anode box to flow electric current from said anode panels through said electrolyte to said cathode, depositing aluminum at said cathode and generating gas at said anode panels;

(d) circulating molten electrolyte upwardly in said cathode slot and downwardly in the region between said cathode slots; and (e) draining aluminum from said bottom end of said cathode through said opening in said anode bottom to said pool of molten aluminum.

18. The method in accordance with claim 17 wherein said electrolyte is comprised of one or more alkali metal fluorides.

19. The method in accordance with claim 17 wherein said electrolyte is comprised of one or more alkali metal fluorides and aluminum fluoride.

20. The method in accordance with claim 17 including maintaining said electrolyte in a temperature range of about 660° to 860° C.

21. The method in accordance with claim 17 wherein said electrolyte has a melting point in the range of 715° to 860° C.

22. The method in accordance with claim 17 including passing an electric current through said cell at a current density in the range of 0.1 to 1.5 A/cm$^2$.

23. The method in accordance with claim 17 wherein said anodes are comprised of 10 to 70 wt. % Cu, 15 to 60 wt. % Ni, the remainder iron, incidental elements and impurities.

24. The method in accordance with claim 23 wherein said cathodes are selected from the group consisting of titanium diboride, zirconium diboride, titanium carbide, zirconium carbide and molybdenum.

25. The method in accordance with claim 17 including adding alumina to said cell on a substantially continuous basis.

26. The method in accordance with claim 17 including maintaining alumina in said electrolyte in excess of solubility.

27. The method in accordance with claim 17 including adding said alumina to the surface of said electrolyte substantially opposite said anode assembly to ingest alumina in said electrolyte circulating downwardly in regions between said cathode slote.

28. The method in accordance with claim 17 wherein said anode panels are perforated to flow alumina-rich electrolyte into said cathode slot.

29. The method in accordance with claim 17 wherein said anode panels have openings therein adjacent said anode bottom to flow alumina-rich electrolyte into said cathode slot and upwardly between said anode plates and said cathode.

30. The anode box in accordance with claim 17 wherein said anode box is comprised of a material selected from the group consisting of cermet, metal and metal alloy.

31. The anode box in accordance with claim 17 wherein said anode box is comprised of a Cu—Ni—Fe alloy.

32. An improved anode for use in an electrolytic cell for producing aluminum from alumina dissolved in molten salt electrolyte contained in said cell, wherein aluminum is deposited at a substantially inert cathode and gas is generated at a substantially inert anode box when electric current is passed through the cell, the cell having a liner for containing molten electrolyte in a layer above a pool of molten aluminum, said anode box designed to be disposed in said electrolyte above said pool of molten aluminum, said anode box comprised of:

(a) a first side, a second side and an anode bottom, said first and second sides disposed substantially opposite each other and attached to said bottom;

(b) two anode panels extending in a generally vertical direction between said first side and said second side to form a cathode slot for receiving a cathode to provide two anode panels for each cathode, said box containing a plurality of spaced-apart cathode slots; and (c) said anode bottom having an opening therein substantially opposite said cathode to permit molten aluminum to drain from said cathode to said pool of molten aluminum during electrolysis.

33. The anode box in accordance with claim 32 wherein said anode box is comprised of a material selected from the group consisting of cermet, metal and metal alloy.

34. The anode box in accordance with claim 32 wherein said anode box is comprised of a Cu—Ni—Fe alloy.

35. The anode box in accordance with claim 32 wherein said anode box is comprised of 10 to 70 wt. % Cu, 15 to 60 wt. % Ni, the remainder iron, incidental elements and impurities.

36. The anode box in accordance with claim 32 wherein said anode box is comprised of 20 to 50 wt. % Cu, 20 to 40 wt. % Ni, and 20 to 40 wt. % Fe.

37. The anode box in accordance with claim 32 wherein said anode panels are perforated to flow alumina-rich electrolyte into said cathode slot.

38. The anode box in accordance with claim 32 wherein said anode panels have openings therein adjacent said anode bottom to flow alumina-rich electrolyte into said cathode slot and upwardly between said anode plates and said cathode.

39. The anode box in accordance with claim 32 wherein the cathode slots are spaced apart to permit electrolyte flow downwardly between said cathode slots.

40. An improved anode for use in an electrolytic cell for producing aluminum from alumina dissolved in molten salt electrolyte contained in said cell, wherein aluminum is deposited at a substantially inert cathode and gas is generated at a substantially inert anode box when electric current is passed through the cell, the cell containing molten electrolyte in a layer above a pool of molten aluminum, said anode box designed to be disposed in said electrolyte above said pool of molten aluminum, said anode box comprised of:

(a) a first side, a second side and an anode bottom, said first and second sides disposed substantially opposite each other and attached to said bottom;

(b) anode panels extending in a generally vertical direction between said first side and said second side to form a cathode slot for receiving a cathode to provide two anode panels for each cathode, said box containing a plurality of spaced-apart cathode slots, said anode panels having openings therein adjacent said anode bottom to flow alumina-rich electrolyte into said cathode slot; and (c) said anode bottom having an opening therein substantially opposite said cathode to permit molten aluminum to drain from said cathode to said pool of molten aluminum during electrolysis.

41. An improved electrolytic cell for producing aluminum from alumina dissolved in a molten electrolyte, the cell comprised of:

(a) a vessel therein having a liner for containing molten electrolyte and a pool of molten aluminum, said liner having a cell bottom and walls extending upwardly from said bottom, the liner designed to contain said pool of molten aluminum on said bottom and molten electrolyte located in top of said pool of molten aluminum;

(b) an anode box adapted to be located in said electrolyte above said pool of molten aluminum, said anode box comprised of:

(i) a first side, a second side and an anode bottom, said first and second sides disposed substantially opposite each other;

(ii) two anode panels extending in a generally vertical direction between said first side and said second side to form a cathode slot, said box containing a plurality of cathode slots spaced apart to provide a region therebetween;

(c) a cathode provided in each of said cathode slots, said cathode having a bottom end, said anode bottom having an opening therein opposite said bottom end of said cathode;

(d) means for passing electric current through said anode box to flow electric current from said anode panels through said electrolyte to said cathode to deposit aluminum at said cathode and produced gas at said anode panels;

(e) means for draining aluminum from said bottom end of said cathode through said opening in said anode bottom to said pool of molten aluminum; and (f) means for circulating molten electrolyte upwardly in said cathode slot between said anode panels and said cathode and downwardly outside said cathode slot.

42. The cell in accordance with claim 41 wherein said anode box is comprised of a material selected from the group consisting of cermet, metal and metal alloy.

43. The cell in accordance with claim 41 wherein said anode box is comprised of a Cu—Ni—Fe alloy.

44. The cell in accordance with claim 41 wherein said anode box is comprised of 10 to 70 wt. % Cu, 15 to 60 wt. % Ni, the remainder iron, incidental elements and impurities.

45. The cell in accordance with claim 41 wherein said anode box is comprised of 20 to 50 wt. % Cu, 20 to 40 wt. % Ni, and 20 to 40 wt. % Fe.

46. The cell in accordance with claim 41 wherein said anode panels are perforated to flow alumina-rich electrolyte into said cathode slot.

47. The cell in accordance with claim 41 wherein said anode panels have openings therein adjacent said anode bottom to flow alumina-rich electrolyte into said cathode slot and upwardly between said anode plates and said cathode.

48. The cell in accordance with claim 41 wherein the cathode slots are spaced apart to permit electrolyte flow downwardly between said cathode slots.

* * * * *